US006345770B1

(12) United States Patent
Simensen

(10) Patent No.: US 6,345,770 B1
(45) Date of Patent: Feb. 12, 2002

(54) MODULAR MANIFOLD

(76) Inventor: Thomas O. Simensen, 158 Crestline Ave., Kalispell, MT (US) 59901

( * ) Notice: Subject to any disclaimer, the term of this patent is extended or adjusted under 35 U.S.C. 154(b) by 0 days.

(21) Appl. No.: 09/834,394

(22) Filed: Apr. 13, 2001

(51) Int. Cl.[7] ..... F24D 5/10
(52) U.S. Cl. ..... 237/69
(58) Field of Search ..... 237/69, 77, 59; 454/185

(56) References Cited

U.S. PATENT DOCUMENTS 4,830,276 A * 5/1989 Sprung ..... 236/49.1

* cited by examiner

*Primary Examiner*—Harold Joyce
*Assistant Examiner*—Derek S. Boles
(74) *Attorney, Agent, or Firm*—Burkhart & Burkhart; Anne K. Burkhart; Patrick N. Burkhart

(57) ABSTRACT

A modular manifold is adapted for use with hydronic circulation systems including a plurality of first and second thermal exchange zones having respective zone supply and zone return lines. The modular manifold includes a plurality of modules, each of which includes a selectively actuatable fluid control mechanism having an inlet and an outlet. The outlet of each selectively actuatable fluid control mechanism is in fluid communication with a respective zone supply line of the zone of the hydronic circulation system. Each module further includes a common return conduit section secured to the selectively actuatable fluid control mechanism. A common supply conduit section is secured to the selectively actuatable fluid control mechanism of each module. The common supply conduit section is in fluid communication with the inlet of the selectively actuatable fluid control mechanism. The modules are adapted and constructed to be connected together, with the collective common return conduit sections fitting together to form a common return conduit in communication with the return lines of the thermal exchange zones, and the collective common supply conduit sections fitting together to form a common supply conduit. The selectively actuatable fluid control mechanisms can be provided as any suitable control mechanism, such as zone pumps or zone valves. A connecting conduit having a first end connected to the common return conduit and a second end connected to the common supply conduit can be provided in the form of a U-bend. An injection mechanism having an inlet connected to a source of thermal exchange fluid and an outlet connected to the connecting conduit can also be provided. The injection mechanism can be provided as an injection pump or an injection mixing valve. A temperature gauge can be connected to the connecting conduit at a location downstream from the injection mechanism outlet. The temperature gauge indicates the temperature of fluid flowing into the common supply conduit. Tee connectors can be provided to connect the modules together, and can include a return inlet conduit connected to the zone return line of the first thermal exchange zone.

20 Claims, 4 Drawing Sheets

MODULAR MANIFOLD

FIELD OF THE INVENTION

The invention relates generally to manifold structures for systems having fluid conduits. Specifically, the invention relates to modular pump or valve manifolds finding particular utility in hydronic heating systems.

BACKGROUND OF THE INVENTION

The practice of controlling the temperature of a building by circulating water has been known since the times of the Roman Empire. Archeological reconstruction has revealed that bath houses often used wood-fired boilers to heat water. The hot water was then used not only in the bath itself, but was as well circulated in sub-floor conduits to heat the floor of the bath house.

Modern hydronic systems, although based on the same concept, incorporate heating, circulation, and control arrangements that would have been unimaginable to the ancients. For example, U.S. Pat. No. 5,390,660 to Danielson is directed to a pre-wired and pre-plumbed module for connection to an installed hydronic radiant floor heating system including a supporting frame having components mounted thereon such as a boiler, pumps, four-way valve, in-line air separator, expansion tank, P/T ports, return valves, supply valves and control panels mounted thereon. The module is assembled at the factory and is tested at the factory to ensure that the components are properly plumbed and wired. Once the module is delivered to the job site, the components of the module are quickly and easily connected to the hydronic radiant floor heating system.

U.S. Pat. No. 4,907,739 to Drake discusses a radiant heating system especially useful for floor heating is provided with a fluid flow apparatus that includes means for pumping a fluid such as water, a temperature-responsive actuator and a valve positionable within a valve housing in response to measured fluid temperature. The system includes heat transfer means, typically a tube embedded in the floor that receives heated fluid from the flow apparatus which in turn receives fluid at generally a higher temperature from a fluid heating apparatus such as a water boiler. The amount of heated fluid recirculated to the heat transfer means is controlled by the position of the valve in the valve housing.

U.S. Pat. No. 4,770,341 to Drake sets forth a manifold which is useful in receiving a heated liquid such as warm water from a suitable source and for distributing that liquid to a plurality of floor heat exchangers and for receiving liquid from the heat and returning that liquid to the source. The manifold includes a plurality of separate manifold elements that can be stacked adjacent one another, each element having a first and second chamber. The first and second chambers of the elements together define first and second distribution vessels within the manifold. Each manifold element includes inlet and outlet ports communicating with the respective distribution vessels for carrying liquid to and from the heat exchangers. The manifold elements desirably are integrally formed from plastic or other material exhibiting a coefficient thermal conductivity of less than 1.0 kcal/M h °C.

U.S. Pat. No. H239 to Franklin is directed to a hydronic heating system that includes a tube or series of tubes placed on modular composite panels. The panels are fabricated with a grooved surface to permit the flush embedment of the tubes on the panels.

Although these arrangements offer some advantages over standard heating and cooling systems, they are complex and expensive. Further, installation of each system involves many hours of plumbing time and a significant amount of equipment. The time and expense involved is increased with each additional zone incorporated into the system. It can be seen from the foregoing that the need exists for a simple, inexpensive modular manifold system that provides fabrication and installation advantages, overcoming the deficiencies of known arrangements.

SUMMARY OF THE INVENTION

These and other objects are achieved by providing a modular manifold for hydronic circulation systems including a plurality of thermal exchange zones having respective zone supply and zone return lines. The modular manifold includes a plurality of modules, each of which includes a selectively actuatable fluid control mechanism having an inlet and an outlet. The outlet of each selectively actuatable fluid control mechanism is in fluid communication with a respective zone supply line of a zone of the hydronic circulation system. Each module further includes a common return conduit section secured to the selectively actuatable fluid control mechanism. A common supply conduit section is secured to the selectively actuatable fluid control mechanism of each module. The common supply conduit section is in fluid communication with the inlet of the selectively actuatable fluid control mechanism. The modules are adapted and constructed to be connected together, with the collective common return conduit sections fitting together to form a common return conduit in communication with the return lines of the thermal exchange zones, and the collective common supply conduit sections fitting together to form a common supply conduit.

The selectively actuatable fluid control mechanisms can be provided as any suitable control mechanism, such as zone pumps or zone valves. A connecting conduit having a first end connected to the common return conduit and a second end connected to the common supply conduit can be provided in the form of a U-bend. An injection mechanism having an inlet connected to a source of thermal exchange fluid and an outlet connected to the connecting conduit can also be provided. The injection mechanism can be provided as an injection pump or an injection mixing valve. A temperature gauge can be connected to the connecting conduit at a location downstream from the injection mechanism outlet. The temperature gauge indicates the temperature of fluid flowing into the common supply conduit. Tee connectors can be provided to connect the modules together, and can include a return inlet conduit connected to the zone return line of the first thermal exchange zone.

A power strip can be connected to a source of electrical power. The power strip includes a power connection for the selectively actuatable fluid control mechanismfor each module. A control panel can be connected to the power strip to selectively actuate the first and second selectively actuatable fluid control mechanisms. The modules, the power strip, and the control panel can be secured to a suitable mounting surface.

The features of the invention believed to be patentable are set forth with particularity in the appended claims. The invention itself, however, both as to organization and method of operation, together with further objects and advantages thereof, may best be understood by reference to the following description, taken in conjunction with the following drawings.

DETAILED DESCRIPTION OF THE INVENTION

Figure 1:
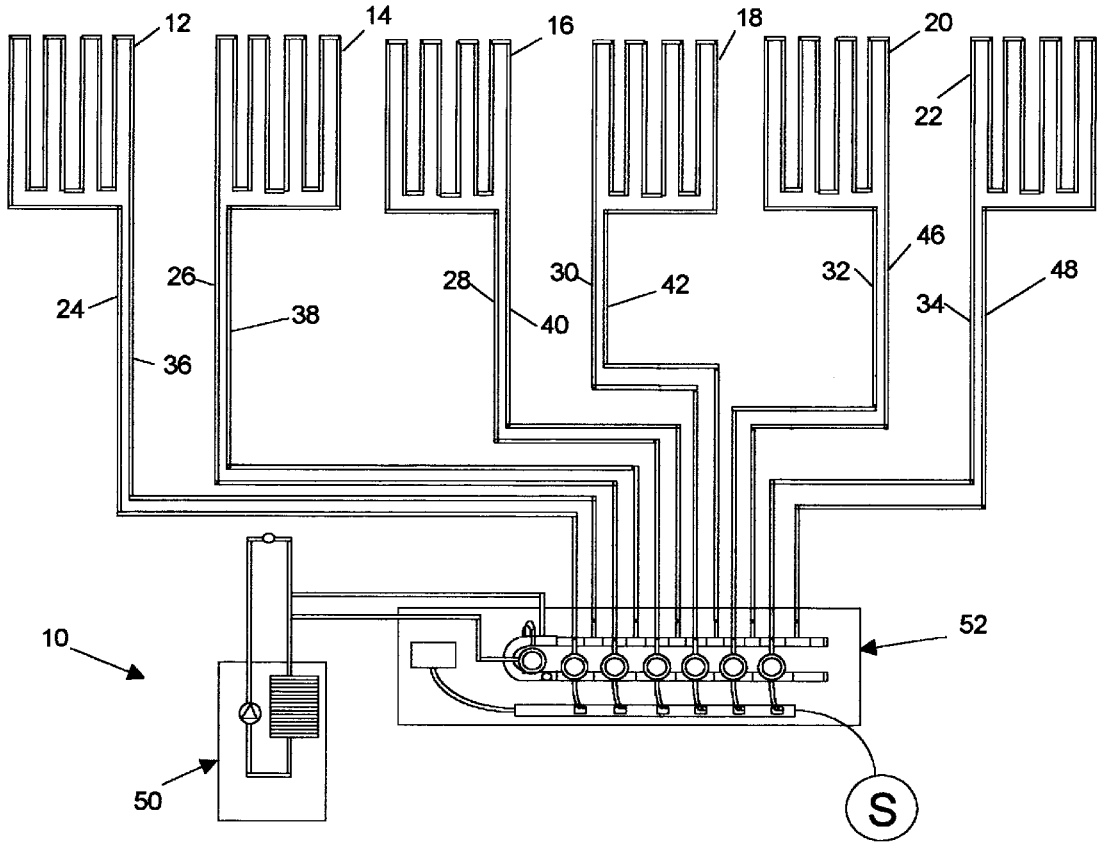
FIG. 1 is a schematic diagram of a hydronic system including a modular manifold incorporating the principles of the present invention.

FIG. 1 illustrates a hydronic circulation system 10 including a plurality of thermal exchange zones 12, 14, 16, 18, 20, and 22. The thermal exchange zones 12–22 can be provided as any suitable fluid-based thermal exchange arrangements, such as in-floor systems, staple-up arrangements, radiators, and the like. Each zone 12, 14, 16, 18, 20, and 22 is provided with a respective zone supply line 24, 26, 28, 30, 32, and 34, and a respective zone return line 36, 38, 40, 42, 46, and 48. Thermal exchange fluid, such as a glycol solution, is circulated from a boiler 50 through the zones 12, 14, 16, 18, 20, and 22 via a modular manifold 52. As is known in the art, the modules can be connected to the boiler 50 by means of an injection line arrangement.

Figure 2:
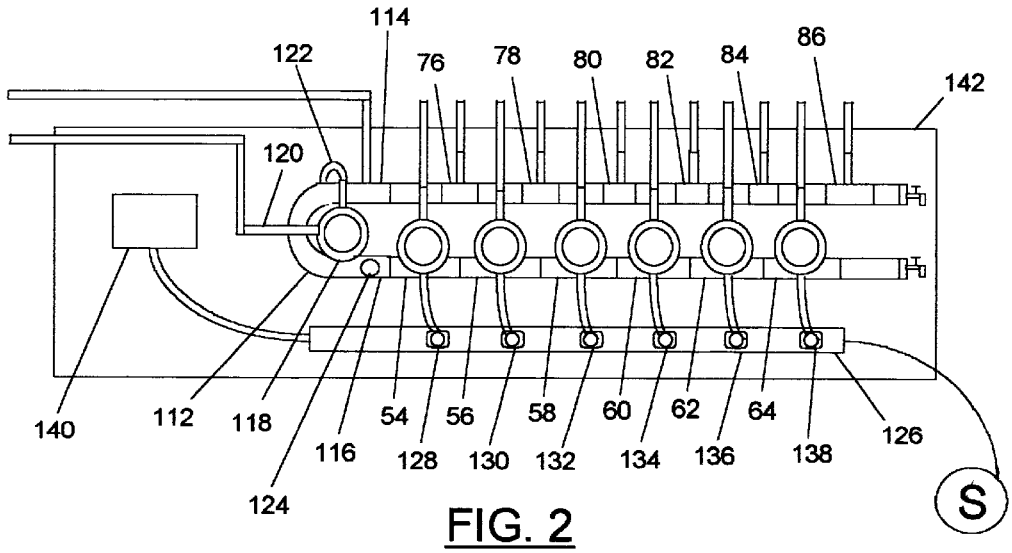
FIG. 2 is a schematic diagram of a modular manifold incorporating the principles of the present invention.
Figure 3:
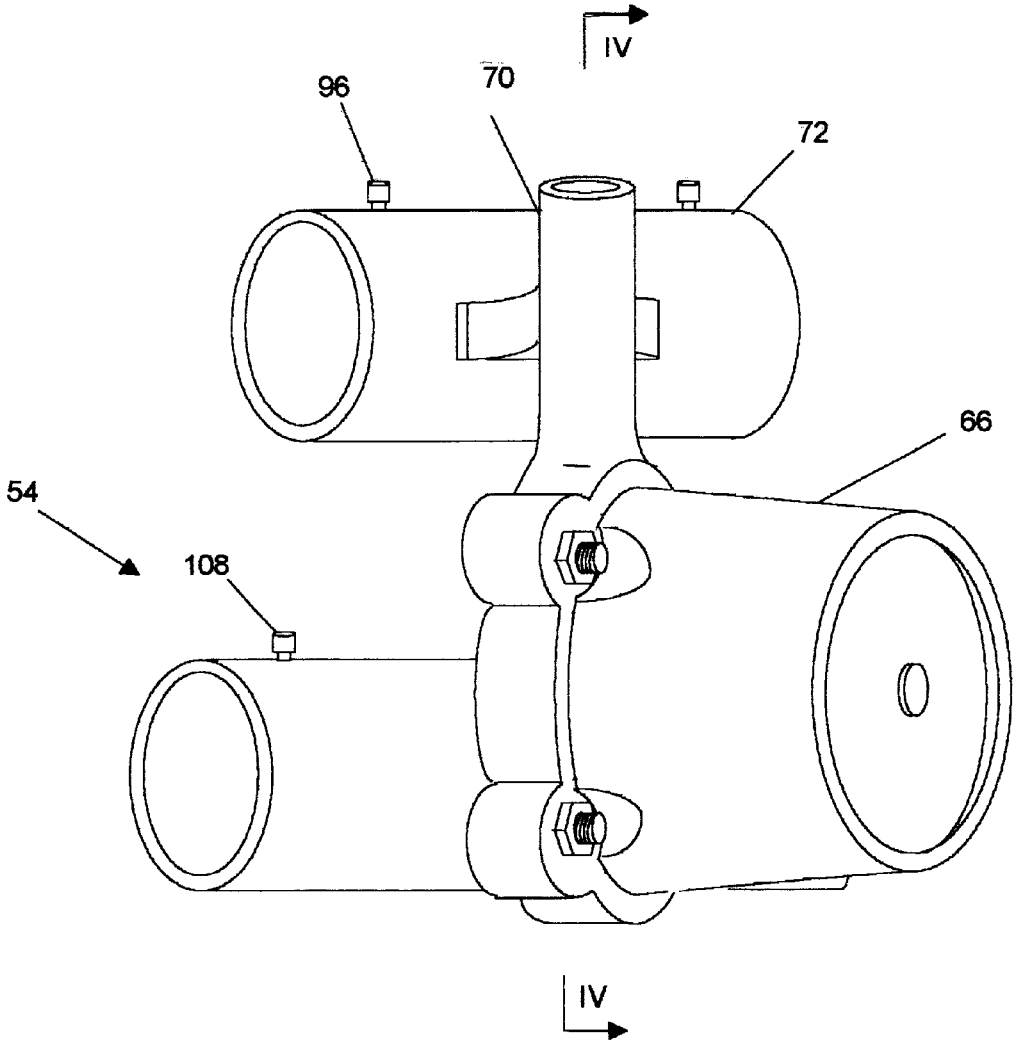
FIG. 3 is a schematic perspective view of a module.
Figure 4:
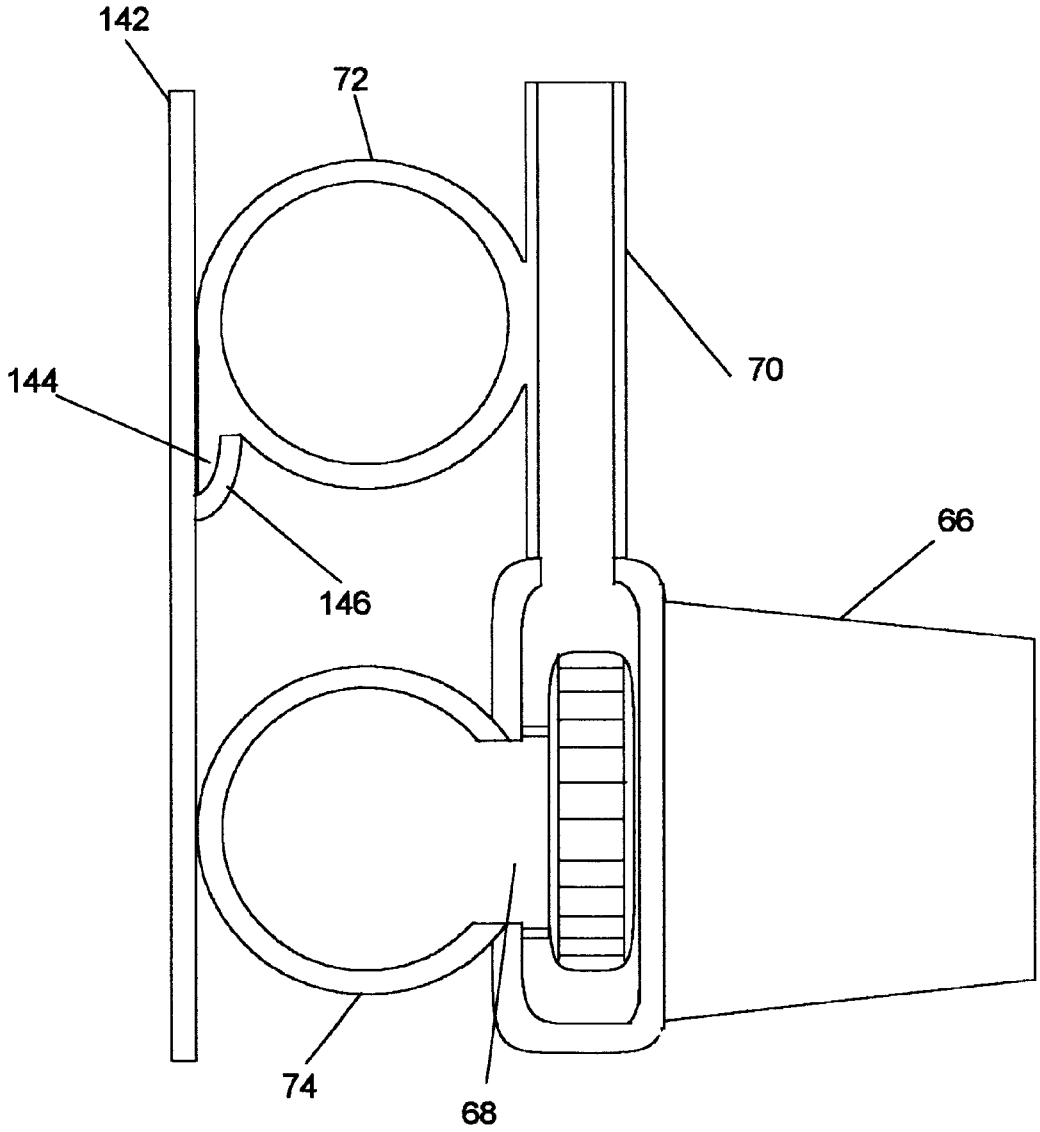
FIG. 4 is a schematic sectional view taken generally along lines IV—IV of FIG. 3.

As seen in FIG. 2, the modular manifold 52 includes a plurality of modules 54, 56, 58, 60, 62, and 64. FIGS. 3 and 4 illustrate the module 54 in detail, showing the features typical of each module. The module 54 includes a selectively actuatable fluid control mechanism 66, here shown as a zone pump having an inlet 68 and an outlet 70. Such zone pumps are known in the art, one examples of which are manufactured by GRUNDFOS. The outlet 70 of the selectively actuatable fluid control mechanism 66 is in fluid communication with the zone supply line 24 of the first zone 12 of the hydronic circulation system 10, and incorporates a check valve 71 to prevent backflow. The module 54 further includes a common return conduit section 72 secured to the selectively actuatable fluid control mechanism 66. A common supply conduit section 74 is secured to the selectively actuatable fluid control mechanism 66. The common supply conduit section 74 is in fluid communication with the inlet 68 of the selectively actuatable fluid control mechanism 66.

Figure 5:
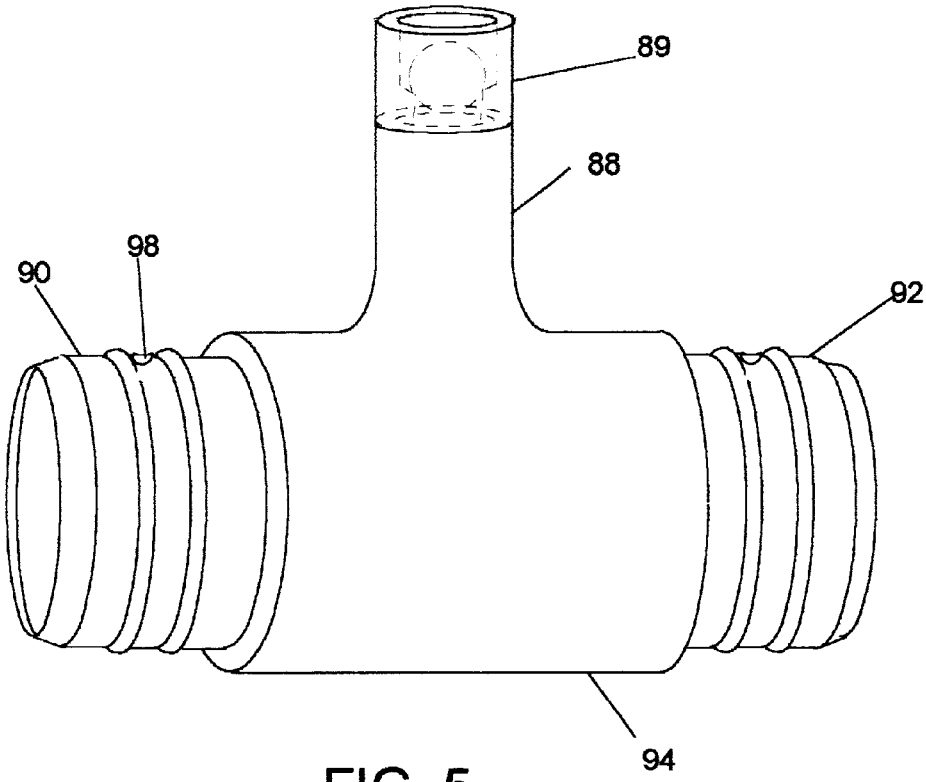
FIG. 5 is a schematic perspective view of a "T" connector.

The modules 54, 56, 58, 60, 62, and 64 are adapted and constructed to be connected together, with the collective common return conduit sections fitting together to form a common return conduit in communication with the return lines of the thermal exchange zones, and the collective common supply conduit sections fitting together to form a common supply conduit. The common return conduit sections can be connected together with Tee connectors 76, 78, 80, 82, 84, and 86 can be provided to connect the modules 54, 56, 58, 60, 62, and 64 together. The Tee connector 76 is shown in detail in FIG. 5, and, and includes a return inlet conduit 88 connected to the zone return line 36 of the first thermal exchange zone 12. A ball valve 89 can be provided to regulate flow into the return inlet conduit 88. Opposed coaxial connecting portions 90, 92 extend outwardly from a central portion 94 of the Tee connector 76. The connecting portion 90 fits into the common return conduit section 72 of the module 54, and the connecting portion 92 fits into the common return conduit section of the module 56. The modules and Tee connectors are provided with a suitable securing mechanism, such as set screws 96 and bores 98.

Figure 6:
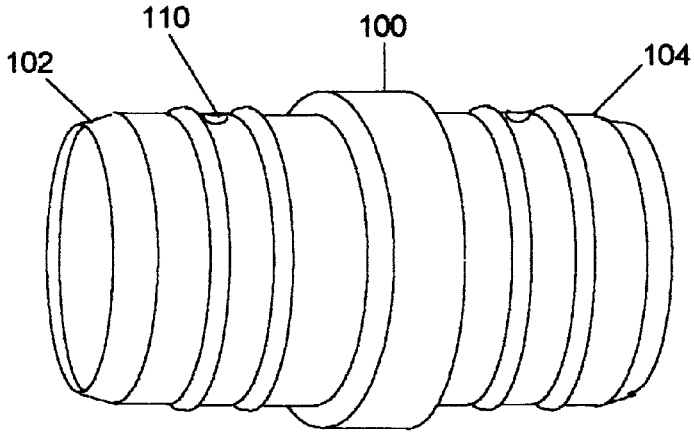
FIG. 6 is a schematic perspective view of a splice sleeve.

The common supply conduit sections are fitted together using a splice sleeve 100, as shown in FIG. 6. Opposed coaxial connecting portions 102, 104 extend outwardly from a central portion 106 of the splice sleeve 100. The connecting portion 102 fits into the common supply conduit section 74 of the module 54, and the connecting portion 104 fits into the common supply conduit section of the module 56. The modules and splice sleeves are provided with a suitable securing mechanism, such as set screws 108 and bores 110.

A connecting conduit module 112 having a first end 114 connected to the common return conduit and a second end 116 connected to the common supply conduit can be provided in the form of a U-bend. An injection mechanism 118, here shown as an injection pump, includes an inlet 120 connected to a source of thermal exchange fluid (the boiler 50) and an outlet 122 connected to the connecting conduit 112. Such as a model l542-F manufactured by GRUNDFOS. or an injection mixing valve. A temperature gauge 124 is connected to the connecting conduit 118 at a location downstream from the injection mechanism outlet 122. The temperature gauge 124 indicates the temperature of fluid flowing into the common supply conduit.

A power strip 126 is connected to a source of electrical power S. The power strip include a power connection 128, 130, 132, 134, 136, and 138 connected to each of the modules 54, 56, 58, 60, 62, and 64. The connection can be hard-wired, or more preferably achieved by standard plug mechanisms. A control panel 140, such as an ARM switching relays available from ARGO Industries of Berlin, CT, USA, or a TEKMAR house control, can be connected to the power strip 126 to selectively actuate the selectively actuatable fluid control mechanisms of the modules 54, 56, 58, 60, 62, and 64.

The modules, the power strip, and the control panel can be secured for convenience and ease of installation. In the illustrated embodiment, the components are secured to a mounting surface 142 via cleats 144 extending from the respective return conduit sections of the modules. The cleats 142 fit into a bracket 146 on the mounting surface 142. It is also contemplated that the entire modular assembly could be mounted directly onto a wall surface, or in a cabinet structure.

The modular structure of the present invention eliminates the need for traditional methods of connecting currently required to interconnect fluid control mechanisms for hydronic zones, such as flange and gasket, threaded connection, or sweat connections. It will eliminate many hours of piping labor, as well as the cost of custom pipe, fittings, and related materials. This will result in a significant cost savings to the homeowner or building owner installing such a system. The present invention also allows for extremely easy addition of zones without custom plumbing, merely by adding additional modules and associated control panel components.

Although the present invention has been described with reference to specific embodiments, those of skill in the art will recognize that changes may be made thereto without departing from the scope and spirit of the invention as defined by the appended claims.

What is claimed is:

1. A modular manifold for hydronic circulation systems including first and second thermal exchange zones having respective zone supply and zone return lines, the modular manifold comprising the following:

a first module including the following:

a first selectively actuatable fluid control mechanism having an inlet and an outlet, the outlet of the first selectively actuatable fluid control mechanism being in fluid communication with the zone supply line of the first zone of the hydronic circulation system;

a first common return conduit section secured to the first selectively actuatable fluid control mechanism; and a first common supply conduit section secured to the first selectively actuatable fluid control mechanism, the first common supply conduit being in fluid communication with the inlet of the first selectively actuatable fluid control mechanism; and a second module including the following:

a second selectively actuatable fluid control mechanism having an inlet and an outlet, the outlet of the second selectively actuatable fluid control mechanism being in fluid communication with the zone supply line of the second zone of the hydronic circulation system;

a second common return conduit section secured to the second selectively actuatable fluid control mechanism; and a second common supply conduit section secured to the second selectively actuatable fluid control mechanism, the second common supply conduit being in fluid communication with the inlet of the second selectively actuatable fluid control mechanism;

whereby the first and second modules are adapted and constructed to be connected together, with the first common return conduit section and second common return conduit section fitting together to form a common return conduit in communication with the return lines of the first and second thermal exchange zones, and the first common supply conduit section and the second common supply conduit fitting together to form a common supply conduit.

2. A modular manifold in accordance with claim 1, wherein the first and second selectively actuatable fluid control mechanisms comprise zone pumps.

3. A modular manifold in accordance with claim 1, wherein the first and second selectively actuatable fluid control mechanisms comprise zone valves.

4. A modular manifold in accordance with claim 1, further comprising a connecting conduit having a first end connected to the common return conduit and a second end connected to the common supply conduit.

5. A modular manifold in accordance with claim 4, wherein the connecting conduit comprises a U-bend.

6. A modular manifold in accordance with claim 4, further comprising an injection mechanism having an inlet connected to a source of thermal exchange fluid and an outlet connected to the connecting conduit.

7. A modular manifold in accordance with claim 6, further comprising a temperature gauge connected to the connecting conduit at a location downstream from the injection mechanism outlet, the temperature gauge being adapted and constructed to indicate the temperature of fluid flowing into the common supply conduit.

8. A modular manifold in accordance with claim 6, wherein the injection mechanism comprises an injection pump.

9. A modular manifold in accordance with claim 6, wherein the injection mechanism comprises an injection mixing valve.

10. A modular manifold in accordance with claim 1, further comprising a first tee connector secured to the first common return conduit section, the first tee connector including a return inlet conduit connected to the zone return line of the first thermal exchange zone.

11. A modular manifold in accordance with claim 10, further comprising a second tee connector secured to the second common return conduit section, the second tee connector including a return inlet conduit connected to the zone return line of the second thermal exchange zone.

12. A modular manifold in accordance with claim 1, further comprising a power strip connected to a source of electrical power, the power strip including a first power connection connected to the first selectively actuatable fluid control mechanism, and a second power connection connected to the second selectively actuatable fluid control mechanism.

13. A modular manifold in accordance with claim 12, further comprising a control panel connected to the power strip, the control panel being adapted and constructed to selectively actuate the first and second selectively actuatable fluid control mechanisms.

14. A modular manifold in accordance with claim 13, further comprising a mounting surface to which the first and second modules, the power strip, and the control panel are secured.

15. In a hydronic circulation system including a plurality of thermal exchange zones, each of the zones having respective zone supply and zone return lines, a manifold module comprising the following:

a plurality of selectively actuatable fluid control mechanisms, each of the fluid control mechanisms having an inlet and an outlet, the respective outlets of the selectively actuatable fluid control mechanisms being in fluid communication with respective zone supply lines of the hydronic circulation system;

a common return conduit section secured to the selectively actuatable fluid control mechanisms;

a common supply conduit section connected to the selectively actuatable fluid control mechanisms, the common supply conduit being in fluid communication with the inlet of the selectively actuatable fluid control mechanism; and a connecting conduit module having a first end connected to the common return conduit and a second end connected to the common supply conduit.

16. A manifold module in accordance with claim 15, wherein the selectively actuatable fluid control mechanisms comprises zone pumps.

17. A modular manifold in accordance with claim 15, wherein the selectively actuatable fluid control mechanisms comprises zone valves.

18. A modular manifold in accordance with claim 15, wherein the connecting conduit comprises a U-bend.

19. Method of assembling a manifold for hydronic circulation systems including first and second thermal exchange zones having respective zone supply and zone return lines, the method comprising the following steps:

providing a first module including a first selectively actuatable fluid control mechanism having an inlet and an outlet, the outlet of the first selectively actuatable fluid control mechanism being in fluid communication with the zone supply line of the first zone of the hydronic circulation system;

securing a first common return conduit section to the first selectively actuatable fluid control mechanism;

securing a first common supply conduit section to the first selectively actuatable fluid control mechanism, the first common supply conduit being in fluid communication with the inlet of the first selectively actuatable fluid control mechanism;

providing a second module including a second selectively actuatable fluid control mechanism having an inlet and an outlet, the outlet of the second selectively actuatable fluid control mechanism being in fluid communication with the zone supply line of the second zone of the hydronic circulation system;

securing a second common return conduit section to the second selectively actuatable fluid control mechanism;

securing a second common supply conduit section to the second selectively actuatable fluid control mechanism, the second common supply conduit being in fluid communication with the inlet of the second selectively actuatable fluid control mechanism;

connecting the first and second modules together, with the first common return conduit section and second common return conduit section fitting together to form a common return conduit in communication with the return lines of the first and second thermal exchange zones, and the first common supply conduit section and the second common supply conduit fitting together to form a common supply conduit.

20. A modular manifold in accordance with claim 18, further comprising the following steps:

providing a connecting conduit having a first and second end;

connecting the first end of the connecting conduit to the common return conduit; and connecting the second end of the connecting conduit to the common supply conduit.

* * * * *